US005141606A

United States Patent [19]

Matsumoto et al.

[11] Patent Number: 5,141,606

[45] Date of Patent: Aug. 25, 1992

[54] METHOD FOR THE ELECTROLYTIC PICKLING OR DEGREASING OF STEEL PLATE

[75] Inventors: Yukiei Matsumoto; Takanobu Hayashi; Yoshiaki Suganuma; Kuniaki Yamada, all of Kanagawa, Japan

[73] Assignee: Permelec Electrode, Ltd., Kanagawa, Japan

[21] Appl. No.: 603,119

[22] Filed: Oct. 25, 1990

[30] Foreign Application Priority Data

Oct. 27, 1989 [JP] Japan ..... 1-278489

[51] Int. Cl.[5] ..... C25F 1/06

[52] U.S. Cl. ..... 204/145 R

[58] Field of Search ..... 204/145 R

[56] References Cited

U.S. PATENT DOCUMENTS 4,391,685 7/1983 Shepard et al. .

4,493,754 1/1985 Abys et al. .

4,544,462 10/1985 Furutani ..... 204/145 R

FOREIGN PATENT DOCUMENTS 0027051 4/1981 European Pat. Off. .

0367112 5/1990 European Pat. Off. .

OTHER PUBLICATIONS

Chemical Abstracts 104:22 pp. 271–272 (Jun. 2, 1986).

Chemical Abstracts 111:24, p. 447 (Dec. 11, 1989).

*Primary Examiner*—T. M. Tufariello

*Attorney, Agent, or Firm*—Sughrue, Mion, Zinn, Macpeak & Seas

[57] ABSTRACT

A method for the electrolytic pickling or degreasing of a steel plate in an aqueous solution having an electrode disposed therein, wherein an insoluble electrode or a ferrite electrode is used as the electrode, said insoluble electrode comprising an electrically conductive substrate having provided thereon directly or through an intermediate layer, an electrode coating containing a platinum group metal or an oxide thereof.

3 Claims, 1 Drawing Sheet

METHOD FOR THE ELECTROLYTIC PICKLING OR DEGREASING OF STEEL PLATE

FIELD OF THE INVENTION

The present invention relates to a method for the electrolytic pickling or degreasing of a steel plate.

The term "plate" and used herein includes a sheet, a ribbon or other shapes.

BACKGROUND OF THE INVENTION

Electrolytic pickling, polishing, or degreasing of steel plates is effected for the removal of oxide layers formed on steel plates after annealing thereof, the removal of undesired materials such as oxides, carbides, silicates, oils or other organic materials, present on steel plates as a pretreatment for plating, or other purposes.

In these steel plate surface treatments, steel plates are immersed in aqueous solutions which are acidic, neutral, or alkaline, and electrolysis is conducted using the steel plates as the anode or cathode while applying direct current or alternating current or both. The removal of undesired surface materials (impurities) such as oxide layers, etc., is accelerated either by the dissolution of the metal at the surface of the steel plate or the generation of oxygen when the steel plate forms the anode or by the generation of hydrogen when the steel plate forms the cathode.

As the electrodes to which current is applied in the electrolytic pickling or polishing, high-silicon cast iron electrodes, i.e., iron-silicon alloy electrodes, have conventionally been used. However, this type of electrodes are defective in that, when used as the anode, iron in the alloys is dissolved away and silicon forms silica which is an electrically insulating material, although such electrodes do not cause particular problem when used as the cathode. For this reason, the voltage increases during the use of such electrodes and, as a result, the electrodes are heated and, hence, distorted and cracked, so that their lives are at the most 3 to 4 months although varied depending on use conditions. Furthermore, silicon or silica is dispersed in the electrolyte and adheres to the steel plate as a silicate in a high pH range to stain the steel plate.

Because of the above, high-silicon cast iron electrodes used must be exchanged frequently for new electrodes and at each time the electrolytic cleaning line must be stopped, resulting in a low production efficiency. In addition, the electrode-exchanging operations are not easy because of the heaviness and fragility of the electrodes. The high-silicon cast iron electrodes also have a problem that they are expensive.

On the other hand, carbon electrodes and graphite electrodes used in electrolytic degreasing, etc., are defective in that they should be made to have a large thickness because their electrical resistance is relatively high and their strength is low, and that these electrodes release carbon particles during electrolysis to contaminate the electrolyte. If such carbon particles adhere to the steel plate, plating of the steel plate results in uneven plating and poor bonding strength of the metal coating. Further, in the case where carbon or graphite electrodes are used as the anode, the electrodes are oxidized by oxygen generated and are consumed with evolution of carbonic acid gas. Accordingly, the carbon or graphite electrodes must also be frequently exchanged for new electrodes and, like the high-silicon cast iron electrodes described above, have the problems such as low production efficiency, difficulty in electrode-exchanging operation, fragility, etc.

SUMMARY OF THE INVENTION

An object of the present invention is to provide a method for the electrolytic pickling or degreasing of a steel plate, which can overcome the problems accompanying the use of the above-described conventional electrodes and makes it possible to conduct stable pickling or degreasing operations at a high efficiency over a prolonged period of time without causing contamination of the electrolyte or stain of the steel plate.

DETAILED DESCRIPTION OF THE INVENTION

According to the present invention, a method for the electrolytic pickling or degreasing of a steel plate in an aqueous solution having an electrode disposed therein is provided, wherein an insoluble electrode or a ferrite electrode is used as the electrode, the insoluble electrode comprising an electrically conductive substrate having provided thereon directly or through an intermediate layer, an electrode coating containing a platinum group metal or an oxide thereof.

Figure 1:
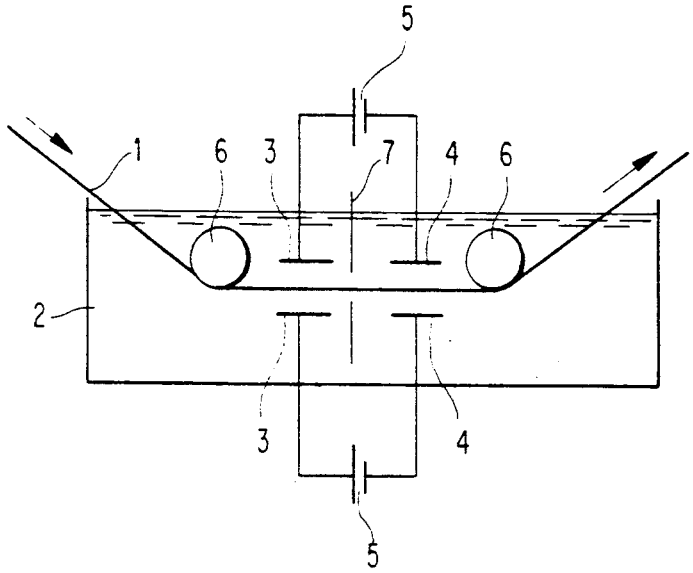
FIG. 1 is a diagrammatic view illustrating one example of the electrolytic pickling method in accordance with the present invention.

The electrolytic pickling or degreasing of a steel plate in accordance with the present invention can be carried out by, for example, introducing and running a steel plate 1 in an aqueous solution electrolyte 2 by means of rolls 6 while an electric current is applied to anodes 3 and cathodes 4 which are disposed in the electrolyte from sources 5 as illustrated in the diagrammatic view in FIG. 1. In this case, the part of the steel plate 1 which is in the chamber on the left side of a partition wall 7 acts as a cathode, while the part of the steel plate which is in the chamber on the right side of the partition wall 7 acts as an anode, and an electric current is indirectly applied to the steel plate.

Further, a directly current-applying method is known, in which electrolytic treatment of a steel plate is effected by directly applying the electric current to the steel plate to form a cathode or an anode, and either an anode or a cathode is placed in the electrolyte so as to face the steel plate.

The method in accordance with the present invention can be applied to both the indirectly current-applying method and the directly current-applying method. In those methods, direct current or alternating current or a combination thereof can be used.

The method of the present invention is explained below in detail.

The electrically conductive substrate of the insoluble electrode which can be used in the method of the present invention is made of Fe, Ni, Ti, Ta, Nb, Zr, or an alloy thereof. From those materials, a proper material for the substrate is suitably selected according to the type of electrolyte, in order to obtain good corrosion resistance. For example, Ti, Ta, Nb, Zr, or an alloy thereof can be used for an acidic bath, while Fe, Ni, or an alloy thereof can be used for a neutral or alkaline bath. In the case where hydrofluoric acid or a fluorine compound is contained in the electrolytic bath, Ta, Nb, or an alloy thereof is suitable as the substrate material.

The electrode substrate can have any desired shape. For example, the substrate can be in the shape of a plate, expanded metal, punching metal, metal gauze, wires fabricated into a reed screen form, etc. In addition, a structure made by electrically bonding an expanded metal, punching metal, metal gauze, reed screen-form wires, metal fiber laminate material, woven metal cloth, wire roll, metallic felt, sintered porous metal, or the like to a plate-like substrate by a conventional fixing means such as bolting, welding, etc., can also be used as the electrode substrate. Two or more such substrates can be superposed on each other, if the substrates are insufficient in strength or electrical conductivity. It is also possible to employ as the electrode substrate a material obtained by treating the surface of any one of the above-described electrode substrates to convert the surface into a nitride, boride, or carbide, and such a surface-treated substrate can suitably be selected according to the composition of the electrolytic bath, etc. In practicing the surface treatment, a conventional method such as ion plating, sputtering, or the like can be used.

From the standpoint of extending the life of the electrode, it is significantly effective to provide an intermediate layer comprising a platinum group metal or at least one metal oxide selected from oxides of Ti, Zr, Nb, Sn, Sb, and Ta between the electrode substrate and the electrode coating. A thickness of intermediate layer is about 10 μm or less, preferably about 5 μm or less. If the intermediate layer has a too large thickness, not only such an electrode becomes expensive but electrolysis voltage increases disadvantageously.

The intermediate layer can be formed over the substrate by, for example, a thermal decomposition method in which a salt of the above-described metals is dissolved in a solvent therefor, the resulting solution is coated on the substrate, and the resulting coating is then thermally decomposed in an oxidizing or reducing atmosphere thereby to deposit the desired oxide or metal on the substrate. Other conventional methods such as sputtering, the CVD process, electroplating, chemical plating, etc., can also be used. A suitable method can be selected according to the desired intermediate layer.

The electrode coating is composed of a material comprising a platinum group metal, an oxide thereof, or a composite material comprising a combination of either the platinum group metal or the oxide thereof with at least one metal oxide selected from oxides of base metal elements such as Ti, Zr, Nb, Sn, Sb, Ta, Co, Si, etc. This electrode coating can be formed by the same method as that for the intermediate layer. That is, conventional methods such as the thermal decomposition, sputtering, electroplating, chemical plating process, or the like can be used. If required and necessary, the electrode coating can be made to have a desired thickness. This can be accomplished, in the case of the thermal decomposition method, by repeating the same coating-forming procedure as described above. In other methods, the desired thickness can be obtained by controlling the amount of electric current applied, the time for coating formation, etc.

The ferrite electrode which can be used in the method in accordance with the present invention can be obtained by a conventional method in which a raw powder comprising $Fe_2O_3$ as a main component and added thereto oxides of various kinds of metals having valencies of from 1 to 5 is sintered. Examples of the elements which can be added to $Fe_2O_3$ include Mn, Fe, Co, Ni, Cu, and Zn. The ferrite has a spinel-type crystal structure. The ferrite electrode can be in a round rod or rectangular plate shape. The thickness of the electrode preferably is from about 3 to 12 mm. Because the ferrite electrode has a high electrical resistance, its shape, size, and thickness should be suitably determined according to the amount of electrical current applied.

The method for the electrolytic pickling or degreasing of a steel plate in accordance with the present invention is advantageous in that the insoluble electrode or ferrite electrode used therein is consumed slightly and has excellent durability, as compared with the conventional high-silicon cast iron electrodes, carbon electrodes, and graphite electrodes. Further, since the insoluble or ferrite electrode does not release contaminants as different from the conventional electrodes, the electrolytic treatment can be conducted at an increased current density without contamination of the electrolyte or stain of the steel plate. Therefore, the rate of steel plate treatment can be greatly improved, so that the production efficiency can be increased and the quality of the treated steel plates can be improved.

In addition, since the electrolysis voltage in the method of the present invention can be kept low as compared with the electrolysis employing the conventional electrodes, the electrical power consumption can be reduced. Furthermore, in the method of the present invention, because of the almost constant electrolysis voltage and the long life of the electrode, electrolytic operation can be conducted in a stable manner over a long period of time.

The electrolyte to be used in the electrolytic pickling is an aqueous solution containing at least one member selected from the group consisting of sulfuric acid, nitric acid, phosphoric acid, polyphosphoric acids, hydrochloric acid, hydrofluoric acid, hydrosilicofluoric acid, hydroborofluoric acid, organic acids, and metal salts of these acids. The conventional electrolyte can be used as the electrolyte in the present invention. The concentration of the electrolyte is generally about 0.1 to 40%. The current density is generally from 5 to 20 $A/dm^2$, but a higher current density can be used. The pickling temperature is generally from room temperature to about 100° C. These conditions are determined according to the type of the steel plate to be treated, whether or not the steel plate has been pretreated, and the desired etching amount for the steel plate. The method of the present invention can be applied to the electrolytic treatment in aqueous ferric chloride solution as described in JP-B-61-59399. (The term "JP-B" as used herein means an "examined Japanese patent publication".)

Electrolytic degreasing has conventionally been conducted using an aqueous solution containing NaOH, $NH_4OH$, $Na_3PO_4$, polyphosphoric acid salts, $NaHCO_3$, $Na_2CO_3$, NaCN, $Na_2SiO_3$, and various kinds of organic acid salts. An aqueous solution selected from such conventional electrolytes can be used in the degreasing of the present invention. Generally used as the organic acid salts are sodium salts of oxalic acid, citric acid, gluconic acid, acetic acid, EDTA, cyanide, and the like. These organic acid salts form complexes with metal ions released from the steel plate treated, and therefore serves to stabilize the electrolyte and prevent the released metal ions from depositing on the steel plate again. The concentration of the electrolyte is generally about 0.1 to 40% as same as in the electrolytic pickling. The current density is generally about 1 to 20 A/dm$^2$, and the degreasing temperature is generally from room temperature to about 100° C. As in the electrolytic pickling, these conditions are suitably determined according to the type of the steel plate treated and other factors.

In the electrolytic pickling or degreasing of a steel plate in accordance with the present invention, the electrolyte and the steel plate are prevented from contamination or staining, since the electrode employed therein is either a ferrite electrode or an insoluble electrode comprising an electrically conductive substrate having provided thereon, an electrode coating containing a platinum group metal or an oxide thereof. Further, the insoluble or ferrite electrode has a long life and enables the electrolytic operations to conduct in a stable manner at a low electrolysis voltage over a prolonged period of time. Accordingly, as compared with conventional processes employing electrodes which are consumed during use, such as high-silicon cast iron electrodes, graphite electrodes, etc., the electrolytic pickling or degreasing method of the present invention is advantageous in that improved product quality and reduced electrical power consumption can be attained and that the production efficiency can be improved because the frequency of electrode exchange is extremely less. Therefore, the method of the present invention is of considerable industrial importance.

The present invention is explained in more detail by reference to the following Examples, which should not be construed to be limiting the scope of the invention.

EXAMPLE 1

Commercially available three titanium plates each having a length of 100 mm, a width of 100 mm, and a thickness of 3 mm were degreased with acetone, subsequently cleaned with hot oxalic acid solution and then with pure water, and then dried to give electrode substrates.

Using the above-obtained electrode substrates, three kinds of electrode samples were prepared as follows.

Sample 1

A solution obtained by dissolving tin chloride and niobium chloride in a molar ratio of 1:1 in ethanol was coated on an electrode substrate, dried, and then calcined at 550° C. for 10 minutes. This procedure was repeated to form an intermediate layer having a thickness of 3 μm over the substrate.

Iridium chloride and platinum chloride in a molar ratio of 2:1 were dissolved in butanol. The resulting solution was applied on the electrode substrate covered with the intermediate layer, dried, and then calcined at 550° C. for 10 minutes. This procedure was repeated to form an electrode coating having a thickness of 15 μm, thereby preparing an electrode.

Sample 2

Ruthenium chloride and titanium chloride in a molar ratio of 1:2 were dissolved in butanol. The resulting solution was coated on an electrode substrate, dried, and then calcined under the same conditions as in Sample 1. By repeating this procedure, an electrode coating having a thickness of 10 μm was formed, thereby preparing an electrode.

Sample 3

A 3 μm-thick intermediate layer of platinum was formed over an electrode substrate by electroplating in which the substrate was used as the cathode and a solution containing chloroplatinic acid, ammonium phosphate, and sodium phosphate was used as the plating solution, and which was conducted at a temperature of 70° to 90° C. at a cathode current density of 0.01 A/cm$^2$. Over the resulting electrode substrate covered with the intermediate layer, an electrode coating composed of iridium oxide and tin oxide in a molar ratio of 1:1 was formed at a thickness of 10 μm in the same manner as in Samples 1 and 2, thereby preparing an electrode.

Using each of the above-obtained three kinds of electrode samples as the anode, continuous electrolysis was conducted with SUS 304 as the cathode to evaluate the life of the anode. The electrolysis conditions including electropickling bath, electrolysis temperature, and current density are shown in the Table below.

For the purpose of comparison, high-silicon (silicon content 15%) cast iron electrode (Comparative sample) having a length of 100 mm, a width of 100 mm, and a thickness of 35 mm as the anode were subjected to the same life tests. The results obtained are shown in the Table below.

TABLE

| Electrode Used | Electrolysis Conditions | Electrical Voltage Change in 6 Months |
|---|---|---|
| Sample 1 | 10% nitric acid; 60° C.; 0.2 A/cm$^2$ | No change |
| Comparative Sample | 10% nitric acid; 60° C.; 0.2 A/cm$^2$ | Voltage increased in 3 months, and electrolysis was impossible thereafter |
| Sample 2 | 5% hydrochloric acid, 20% ferric chloride; 50° C.; 0.3 A/cm$^2$ | No change |
| Comparative Sample | 5% hydrochloric acid, 20% ferric chloride; 50° C.; 0.3 A/cm$^2$ | Voltage increased in 2 months, and electrolysis was impossible thereafter |
| Sample 2 | 20% sodium sulfate; 90° C.; 0.2 A/cm$^2$ | No change |
| Comparative Sample | 20% sodium sulfate; 90° C.; 0.2 A/cm$^2$ | Electrode cracked in 3 months, and electrolysis was impossible thereafter |

EXAMPLE 2

A metallic niobium plate having the same size as in the substrate used in Example 1 was used as an electrode substrate. In the same manner as in Example 1, this substrate was pretreated, and a 3 μm-thick intermediate layer of platinum was formed over the substrate by plating. A solution obtained by dissolving iridium chloride and platinum chloride in a molar ratio of 1:2 in butanol was applied on the intermediate layer, dried, and then calcined in a reducing atmosphere at a temperature of 550° C. This procedure was repeated to form an Ir-Pt coating at a thickness of 3 μm over the intermediate layer, thereby preparing an electrode. Likewise, a total of four electrodes of the same structure were prepared. These electrodes were disposed as the anodes 3 and cathodes 4 in the apparatus as shown in FIG. 1, and subjected to an electrode life test in a solution containing 5% nitric acid and 2% hydrofluoric acid. This life test was conducted by cyclically repeating 10 hour electrolysis conducted at an anode current density of 0.1 A/cm$^2$ at a temperature of 50° C. and a 2 hour stoppage of the electrolysis.

For the purpose of comparison, the same high-silicon cast iron electrodes as in the comparative electrodes used in Example 1 were subjected to the same life test as above.

Figure 2:
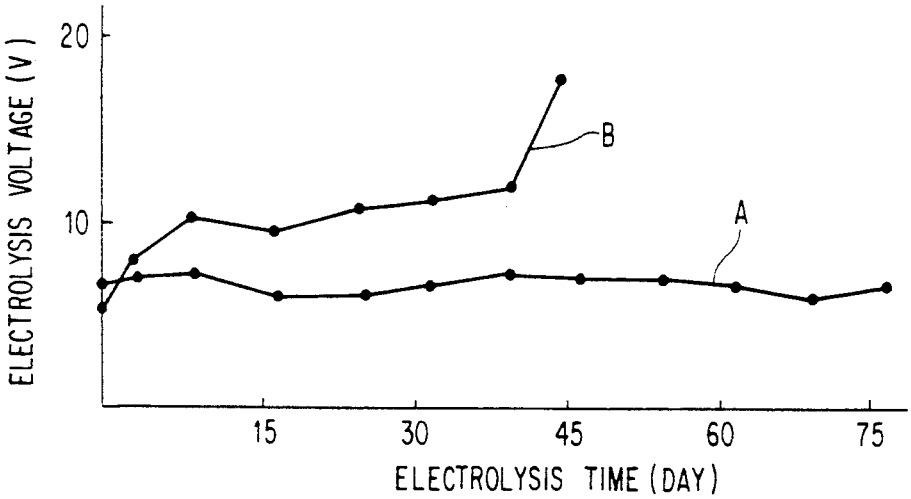
FIG. 2 is a graphical illustration showing a comparison in electrolysis voltage change with the passage of time between an electrolytic pickling method in accordance with the present invention and a conventional method.

The changes of electrolysis voltages with the passage time are shown in FIG. 2, in which curve A is for the example of the present invention and curve B is for comparative example.

Figure 3:
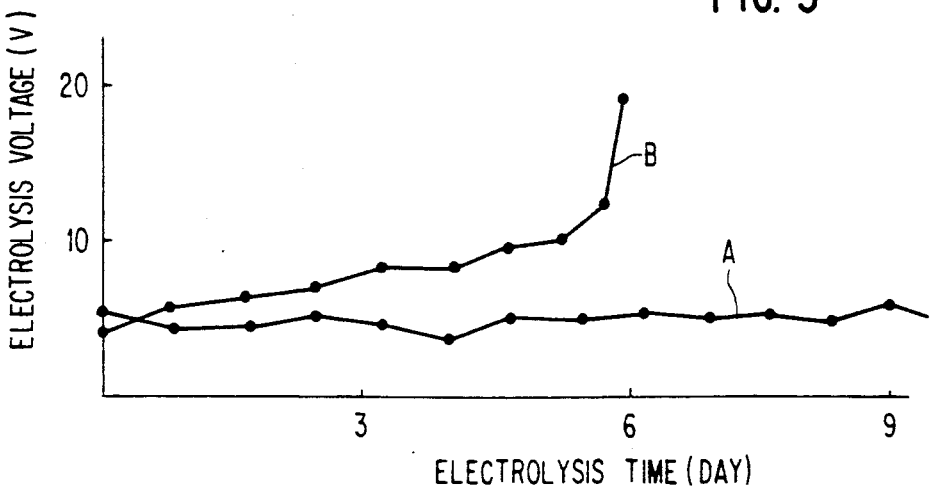
FIG. 3 is a graphical illustration showing a comparison in electrolysis voltage change with the passage of time between an electrolytic degreasing method in accordance with the present invention and a conventional method.

FIG. 2 shows that the electrolysis of the present invention, in which the insoluble electrodes were used as the anodes and cathodes, was conducted at electrolysis voltages about 3 V lower than that in the comparative example using the high-silicon cast iron electrode. It is also shown in FIG. 3 that the electrolysis voltage in the comparative example began to increase when 30 days or so had passed and it was impossible to apply electrical current after 45 days, whereas in the example of the present invention the electrical voltage was stable even after 75 days.

EXAMPLE 3

One-month continuous electrolysis was conducted to clean a steel plate as the cathode, using a ferrite electrode having a thickness of 10 mm, a length of 100 mm, and a width of 100 mm as the anode. This electrolysis was effected in a solution containing 30 g/l sodium hydroxide, 30 g/l sodium citrate, and 10 g/l sodium cyanide at a temperature of 60° C. at a current density of 0.1 A/cm$^2$.

For the purpose of comparison, a graphite electrode having the same size as above was used as an anode and was subjected to the same electrolysis.

Immediately after start of applying the electric current, the graphite electrode-employing electrolyte became turbid blackly due to graphite particles dispersed therein, whereas no substantial change was observed in the ferrite electrode-employing electrolyte. After one-month application of the electric current, each electrode was inspected, and as a result, it was found that considerable part of the graphite electrode had been consumed, whereas the ferrite electrode had undergone no substantial change although consumed only to a slight degree. It was also found that the steel plate treated by using the graphite electrode had adsorbed graphite fine particles. Since the graphite particles could not be removed by water washing, the steel plate was required to be subjected to pickling again.

EXAMPLE 4

Commercially available titanium plates were treated in the same manner as in Example 2 thereby to prepare Ir-Pt electrodes having an intermediate layer of platinum formed by plating. Using these electrodes and high-silicon cast iron electrodes as the comparative electrode, continuous electrolytic degreasing of a steel plate was conducted using the same electrolytic cell as used in Example 2. This electrolysis was effected in an electrolyte containing 30 g/l sodium carbonate, 20 g/l sodium hydroxide, and 30 g/l sodium tertiary phosphate at an anode current density of 0.05 A/cm$^2$ at a temperature of 90° C.

The changes with the passage of time of the electrolytic cell voltages are shown in FIG. 3, in which curve A is for the example of the present invention and curve B is for the comparative example.

FIG. 3 shows that the electrolysis voltage in the comparative electrolysis employing high-silicon cast iron electrodes was about 1 V lower than that in the example of the present invention for the initial 1 month or so, but thereafter the voltage increased gradually and application of the electric current became impossible at the time when about 6 months had passed.

On the other hand, in the example of the present invention, stable electrolysis could be conducted even after 10 months.

While the invention has been described in detail and with reference to specific embodiments thereof, it will be apparent to one skilled in the art that various changes and modifications can be made therein without departing from the spirit and scope thereof.

What is claimed is:

1. A method for electrolytically pickling or degreasing a steel plate immersed in a bath of an aqueous electrolytic solution using an insoluble electrode disposed therein, wherein an insoluble electrode is used as the electrode, said insoluble electrode comprising an electrically conductive substrate having provided thereon directly or through an intermediate layer, an electrode coating containing a platinum group metal or an oxide thereof, and the electrically conductive substrate of the insoluble electrode is composed of one member selected from the group consisting of Fe, Ni, Ti, Ta, Nb, Zr, and alloys of those metals, and a material obtained by treating the surface of a material made of any one of those metals to convert the surface into a nitride, boride, or carbide of the metal.

2. A method as claimed in claim 1, wherein the insoluble electrode has an intermediate layer between the electrically conductive substrate and the electrode coating, said intermediate layer containing a platinum group metal or at least one metal oxide selected from the group consisting of oxides of Ti, Ta, Nb, Zr, Sb, and Sn.

3. A method as claimed in claim 1, wherein the electrode coating of the insoluble electrode a platinum group metal, an oxide thereof, or a combination of either a platinum group metal or the oxide thereof with at least one metal oxide selected from the group consisting of oxides of Ti, Ta, Nb, Zr, Sb, Sn, Co, and Si.

* * * * *